United States Patent [19]

Komatsu et al.

[11] 3,933,483

[45] Jan. 20, 1976

[54] SILICON-CONTAINING NICKEL-ALUMINUM-MOLYBDENUM HEAT RESISTING ALLOY

[75] Inventors: Noboru Komatsu; Takatoshi Suzuki; Nobuyuki Yamamoto; Yukikazu Tsuzuki, all of Nagoya, Japan

[73] Assignee: Kabushiki Kaisha Toyota Chuo Kenkyusho, Japan

[22] Filed: Jan. 15, 1975

[21] Appl. No.: 541,251

Related U.S. Application Data

[63] Continuation-in-part of Ser. No. 376,954, July 6, 1973, abandoned.

[30] Foreign Application Priority Data

July 14, 1972 Japan ..... 47-70960

[52] U.S. Cl. ..... 75/170; 148/32; 148/32.5

[51] Int. Cl.[2] ..... C22C 19/03

[58] Field of Search ..... 75/170, 171; 148/32, 32.5

[56] References Cited

UNITED STATES PATENTS

| | | | |
|---|---|---|---|
| 1,461,178 | 7/1923 | Cooper | 75/170 |
| 2,542,962 | 2/1951 | Kinsey | 75/170 |

*Primary Examiner*—R. Dean

*Attorney, Agent, or Firm*—Hill, Gross, Simpson, Van Santen, Steadman, Chiara & Simpson

[57] ABSTRACT

An alloy of nickel-aluminum-molybdenum containing silicon in the ranges enclosed between points A (nickel—85% by weight, aluminum—5% by weight, molybdenum—10% by weight), B (nickel—75%, aluminum—15%, molybdenum—10%), C (nickel—65%, aluminum—15%, molybdenum—20%) and D (nickel—75%, aluminum—5%, molybdenum—20%) as shown in FIG. 1 and including silicon in the range of 0.1 to 3% by weight and preferably in a range of 0.5 to 2.5% by weight.

11 Claims, 6 Drawing Figures

Fig. 1
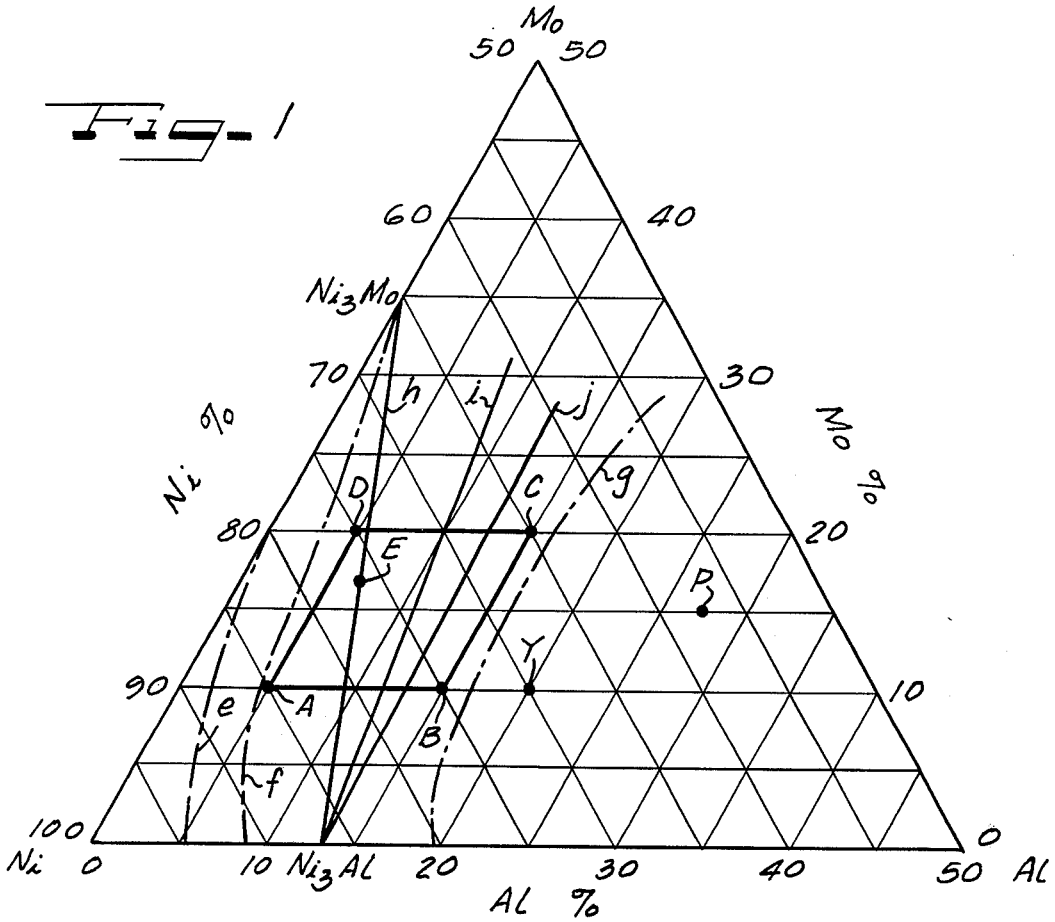
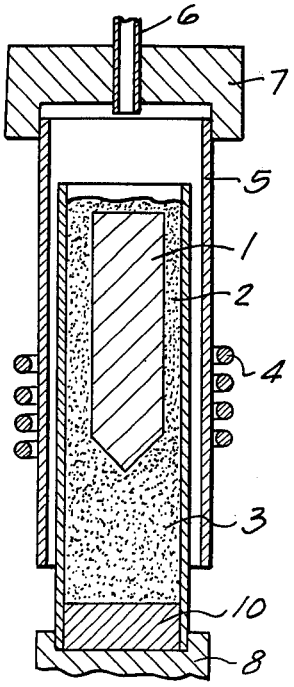
Fig. 2
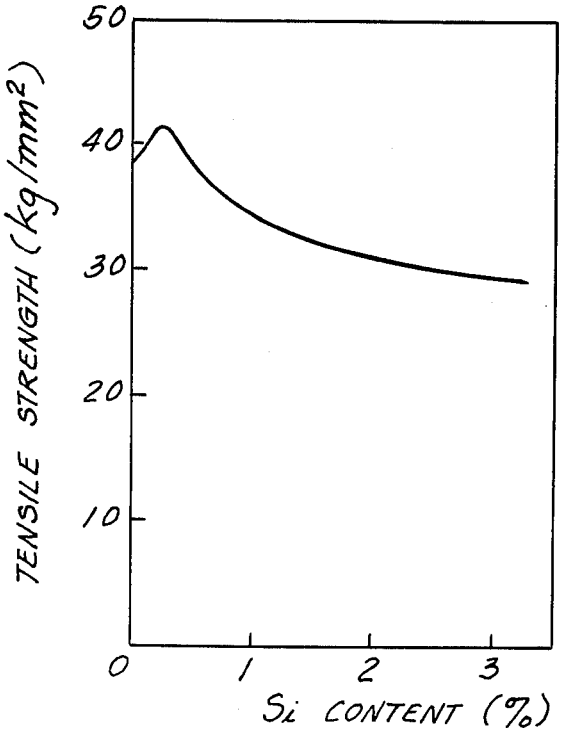
Fig. 6

SILICON-CONTAINING NICKEL-ALUMINUM-MOLYBDENUM HEAT RESISTING ALLOY

CROSS REFERENCE TO RELATED APPLICATION

This is a continuation-in-part of our copending application Ser. No. 376,954 filed July 6, 1973, now abandoned.

BACKGROUND OF THE INVENTION

1. Field of the Invention

This invention relates to a heat resisting alloy which not only retains a high oxidation resisting property at a high temperature but also excels in tensile strength at high temperature and toughness at a room temperature.

2. Description of the Prior Art

The number of equipments and parts to be employed at a high temperature exceeding 1,000°C has increased as a result of the industrial progress and the technical advancement attained during recent years. There are ever-increasing demands for heat resisting materials that can be used for parts exposed to high temperatures and heavy loads such as rocket shells, atomic thermo-engines, combustion chambers and jet pipes of jet engines, parts of gas turbines, high temperature and high pressure apparatuses used in chemical industries, high temperature valves, etc. To meet the requirements for such heat resisting materials, there have been conducted many technical researches and thus many kinds of heat resisting alloys have been used. However, it is generally believed that heat resisting steel is applicable to temperatures below 800°C while the heat resisting alloy containing nickel (Ni) or cobalt (Co) as a basic component is applicable to temperatures below 1,000°C. At temperatures higher than the above temperatures, they not only deteriorate in strength but also greatly deteriorate in oxidation resisting property and cannot be used for a long period of time. Although ceramics and super heat resistant alloys such as molybdenum (Mo), niobium (Nb) and tantalum (Ta) alloys can be used for a long time at temperatures higher than 1,000°C, such super heat resistant alloys have a very poor oxidation resisting property, which either restrict the applicable ambient and operating conditions or require an antioxidation surface treatment. On the other hand, ceramics lack ductility and resistance to thermal shocks. Ceramics tend to break due to sudden changes in temperature. Such conventionally employed high temperature materials thus possess many shortcomings and require improvement.

SUMMARY OF THE INVENTION

The object of this invention is to provide a heat resisting alloy which is free from the above stated shortcomings of the conventional heat resisting materials and which excels in oxidation resisting property at temperatures between 1,000° and 1,200°C or therabout as well as in strength. In their research for such heat resisting alloys of the present invention, the present inventors concentrated on the oxidation resisting property and tensile strength at high temperatures which are prerequisite to heat resisting materials, and toughness at room temperature. Noticing that nickel aluminum ($Ni_3Al$) (an intermetallic compound) greatly excels in oxidation resisting property at high temperatures compared with the conventional heat resisting alloys, the inventors attempted to increase the tensile strength at high temperatures and toughness at room temperatures without impairing the oxidation resisting property of the $Ni_3Al$. As a result of such efforts, they have discovered that an alloy composed of $Ni_3Al$, Mo and a small quantity of silicon (Si) as an additive is most suitable for use as heat resisting alloy. In other words, said alloy is a silicon-containing Ni—Al—Mo alloy of the present invention which comprises Ni, Al and Mo, as basic components, lying within the range as enclosed by straight lines connecting points A (85% Ni, 5% Al and 10% Mo), B (75% Ni, 15% Al and 10% Mo), C (65% Ni, 15% Al and 20% Mo) and D (75% Ni, 5% Al and 20% Mo) in a Ni—Al—Mo triangular coordinate diagram shown in FIG. 1, and 0.1 to 3% of silicon (Si) with the silicon preferably in a range of 0.5–2.5%. (Here and hereinafter % means percent by weight and Ni, Al and Mo within this range will be called "basic components.") The silicon-containing Ni—Al—Mo alloy of the present invention is the best in terms of oxidation resisting property and tensile strength at high temperatures, and toughness at room temperature.

BRIEF DESCRIPTION OF THE DRAWINGS

Other objects, features and advantages of the invention will be readily apparent from the following description of certain preferred embodiments thereof, taken in conjunction with the accompanying drawings, although variations and modifications may be effected without departing from the spirit and scope of the novel concepts of the disclosure, and in which:

FIG. 1 is a triangular coordinate diagram represented by weight percentage which shows the compositions of Ni, Al and Mo.

FIG. 2 is a sectional view showing of a metal melting device for preparation of uni-directionally solidified rod to be used in tensile tests, etc.

FIG. 6 is another graph showing the relation of the tensile strength at 1,100°C of the alloy shown in FIG. 5 to the Si content thereof.

DESCRIPTION OF THE PREFERRED EMBODIMENTS

Figure 3:
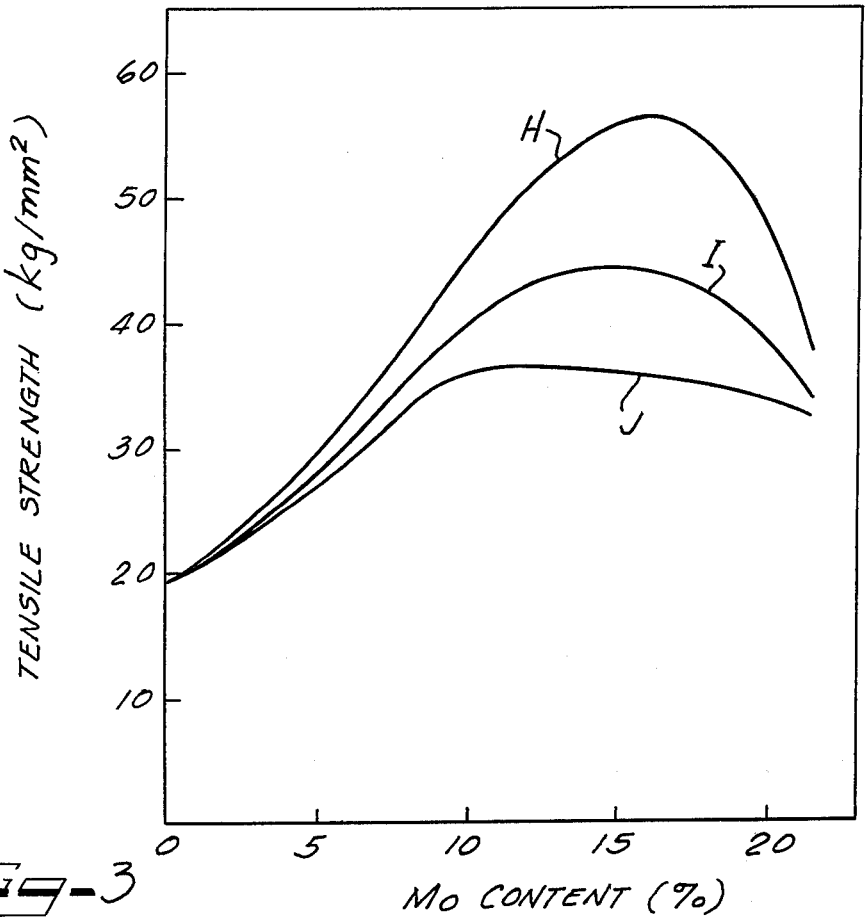
FIG. 3 is a graph showing the relation of the tensile strength at 1,000°C of the Ni—Al—Mo alloys to the Mo content thereof.

FIG. 1 is an equilateral triangular coordinate diagram with three sides having equally divided graduations. In FIG. 1, the ratios of Ni below 50% are omitted. The percent by weight of Al is plotted on the base while that of Ni is plotted on the left side and that of Mo on the right side of the triangle. Thus, the percent by weight of Al is represented by the lines parallel to the left side; that of Ni by the lines parallel to the right side and that of Mo by the lines parallel to the base. For example, the point Y shown in FIG. 1 denotes a composition of 70% Ni, 20% Al and 10% Mo.

Although the invented alloy is composed of basic components, Ni, Al and Mo, to form a basic constituent, and an additive, Si, the ratios of Ni, Al and Mo as shown in FIG. 1 represent the ratios among the basic components only in the basic constituent and do not represent the ratios in the alloy containing the additive. For example, the composition of an alloy composed of 98% of basic constituent or components (70% Ni, 10% Al and 20% Mo) and of 2% of Si is as follows: Ni = 70 × 0.98 = 68.6 (%); Al = 10 × 0.98 = 9.8 (%); Mo = 20 × 0.98 = 19.6 (%); and Si = 2 (%). Accordingly, the invented heat resisting alloy is composed of 0.1 to 3% of Si and of 97 to 99.9%. of the above stated basic constituent comprising Ni, Al and Mo.

The quantity of Al which is one of the basic components is confined within the range from 5 to 15% as shown in FIG. 1 for the following reasons. As is well known, in a Ni based heat resisting alloy composed of only $\gamma$ phase which presents a solid solution of Ni, the desired strength cannot be obtained at the desired temperatures. In order to obtain sufficiently high strength, it is essential to have at least the precipitate of $Ni_3Al$ dispersed in the $\gamma$-phase or to have $Ni_3Al$ as a principal component. Ni—Al—Mo alloys having the compositions which are on the left side of the curve *e* in FIG. 1, that is the compositions with less quantity of Al, present only a $\gamma$-phase at room temperature. However, at a temperature of 1,200°C, such a $\gamma$-phase of the Ni—Al—Mo alloys shifts to the left side of the curve *f*. Ni—Al—Mo alloys of compositions on the left side of the curve *f* thus begin to greatly lose their strength at 1,200°C. In view of this, the minimum limit of the amount of Al which is one of the basic components of a silicon-containing Ni—Al—Mo alloy of the present invention, is specified to be 5%. On the other hand, Ni—Al—Mo alloys having the compositions which are on the right side of the curve *g* with less quantity of Mo, are composed of only NiAl (an intermetallic compound) with Ni and Mo in solid-solution therein (called "$\gamma'$-phase" here) at 1,200°C of thereabout and are guite inferior in high temperature strength. Furthermore, Ni—Al—Mo alloys having the compositions on the right side of the curve g, with a greater quantity of Mo, are composed of an eutectic alloy of the above stated $\gamma'$-phase and Mo with Ni and Al in solid-solution therein at 1,200°C or thereabout; and thus the alloys become very brittle and weak as temperatures increase. Particularly, when the $\gamma'$-phase is suddenly cooled from a high temperature, there takes place a Martensite type transformation and the alloy composed of the $\gamma'$-phase is hardened and becomes extremely brittle. Ni—Al—Mo alloys containing Al in the amount shown on the left side of the curve *g* as shown in FIG. 1 and also containing the basic components within the range ABCD, show toughness of more than 50kg when subjected to a test described herein.

Whereas, a Ni—Al—Mo alloy having the composition as represented by the point P in FIG. 1 (57.5% Ni, 27.5% Al and 15% Mo) shows a low toughness value between 1 and 10kg. In view of this, the maximum limit of the amount of Al of the invented alloy is specified to be 15%.

The quantity of Mo which is one of the basic components of a Si-containing Ni—Al—Mo alloy of this invention is restricted within the range from 10 to 20% as shown in FIG. 1, because the Mo content between 10 to 20% gives a Ni—Al—Mo alloy which not only possesses a great high temperature strength but also excels in toughness at room temperatures. With different Mo contents in an alloy having a $Ni_3Al$ alloy as a principal component, the peak value of high temperature tensile strength appears at the Mo content ranging from 10 to 20%. This is the reason for limiting the Mo contents to between 10 and 20% as a basic component of the alloy of this invention.

A silicon-containing Ni—Al—Mo alloy composed of the basic components Ni, Al and Mo and of 0.1 to 3% of Si as an additive shows a salient improvement in oxidation resisting property at high temperatures because of the addition of Si. On the other hand, according to our experiences, addition of Si to the conventional $Ni_3Al$ heat resisting alloy did not serve to increase the oxidation resisting property and, on the contrary, the oxidation was accelerated. Whereas, in the invented alloy wherein 0.1 to 3% of Si is added to a Ni—Al—Mo alloy composed mainly of $Ni_3Al$ and Mo, the oxidation resisting property at high temperature greatly increases. The oxidation resisting property, however, saliently decreases as the additional quantity of Si comes below 0.1% or exceeds 3%.

As described in the foregoing, a Si-containing Ni—Al—Mo alloy of this invention which comprises Ni, Al and Mo within the range of ratios as enclosed by the points A, B, C and D in FIG. 1 as the basic components or basic constituent and which further contains 0.1–3% of Si, possesses excellent high temperature strength and a high oxidation resisting property at high temperatures.

The Si-containing Ni—Al—Mo alloy of this invention will be further explained with the following test examples and embodiments showing the mechanical strength of the invented alloy.

Each of the alloys for the test examples was prepared by employing all of or a part of metallic Ni, high purity Al, metallic Mo and high purity Si as materials, by melting those materials in alumina crucibles under argon gas as a protective atmosphere by the high frequency heating method and by casting the resulted molten metal into a metal mold. The casted products were subjected to the oxidation resisting test, the tensile test, and the impact strength test as hereunder described. It is known that the mechanical properties of $Ni_3Al$ greatly vary with the solidfying direction, i.e., $Ni_3Al$ has anisotropy. In view of this, the test pieces for tensile strength, thermal expansion, and impact strength were made from rods having uni-directional solidification so as to have the same solidfying direction thereof. A uni-directional solidification device is represented by a sectional view in FIG. 2 and was employed in order to make such test pieces. Referring to FIG. 2, a quartz tube 2 has its lower end sealed with a heat resisting material 10 for retaining a sample. The quartz tube is supported and can be moved up and down by a support 8. There is provided a heat resisting glass tube 5 outside of the quartz tube 2 for the purpose of covering the inner and outer circumferences of the tube 2 with an inert gas. A sealing member 7 is provided on the upper end of the glass tube 5. For introducing the inert gas, a small tube 6 is provided in the sealing member 7 which seals the upper end of the glass tube 5. A high frequency work coil 4 is provided on the outside of the glass tube 5. Since the upper and circumferential parts of the quartz tubes are covered by the sealing member 7 and the heat resisting glass tube 5, the inert gas introduced through the small tube 6 covers the inside, upper part and circumferential part of the quartz tube 2 to shut out atmosphere. The inert gas is discharged into atmosphere through the lower end of the glass tube 5. To obtain a uni-directional solidifed rod by using the above described device a bed 3 of alumina powder ($Al_2O_3$) and sample 1 were placed in the quartz tube 2. Then, the air inside the quartz tube 2 was replaced with argon gas by continuously supplying the argon gas through the small tube 6. After that, a high frequency current was applied to the high frequency work coil 4 to melt the sample 1 by means of heating it from the lower part thereof. The support 8 was gradually moved downward so that the sample 1 was solidified from the lower end thereof. In this manner, a uni-directionally solidified rod for making test pieces with the directions of their crystals arranged in the longitudinal direction was produced.

For the tensile test, the test piece was made from the above stated uni-directionally solidified rod by processing it into a size of 35 mm in full length, 4 mm in diameter at its parallel part and 17 mm in length of the parallel part. The test piece was kept at each test temperature (1,000°–1,200°C) for 15 minutes before the tensile test, and then it was tested with a pulling speed of 2.5 mm/min. The test results are shown in tensile strength kg/mm$^2$.

For the oxidation test which examines the oxidation resisting property, the test pieces were prepared by cutting the above stated rod to a diameter of 10 mm and a length of 10 mm. The whole of faces of each of the test pieces was polished into a metallic surface. The test pieces were heated in the air atmosphere at 1,200°C for 5, 21, and 69 hours, respectively. Following this, the weight of each test piece was measured. There was an increase of the weight thereof due to oxidation in each test piece. From this test, the oxidation weight ($\Delta$ *wg*) and spalling (flaking, exfoliation) weight ($\Delta$ *wf*) were obtained in the following manner. Assuming that the weight of the test piece before the oxidation test is W*o* and its surface area is S*o*, while the weight of the test piece after the oxidation test is W*g* and the weight of the oxide spalled off is W*f*, the oxidation weight ($\Delta$ W*g*) can be expressed as follows:

$$\Delta Wg = \frac{Wg + WF - Wo}{So}$$

The spalling weight ($\Delta$ w*f*) then can be expressed as follows:

$$\Delta Wf = \frac{Wf}{So}$$

These weights are expressed in mg/cm$^2$. Smaller value of the oxidation weight ($\Delta$ *wg*) indicates a better oxidation resisting property.

In the toughness test, samples are pressed with a Vicker's hardness tester which is generally employed in estimating the toughness of hard metals. The toughness is judged by the load which produces cracks around the trace of pressure impressed with the load. Samples that tend to produce such cracks under a lighter load are judged to be brittle.

Samples were subjected to varied Vicker's loads of 1, 5, 10, 20, 30, and 50 kg. respectively. Three times indentation were impressed on different parts of each of the samples with each load to examine whether or not cracks were produced with the same load. The maximum load (kg) that produces no cracks in all of the three impressed traces is considered to be the degree of toughness.

In addition to the above stated tests, some of the test pieces were subjected to an ordinary Charpy impact test. For this, each test piece was prepared from the above stated uni-directally solidified rod by cutting it to 10 mm square, 55 mm long with a U-shaped notch of 1 mm in radius and 2 mm in depth provided in the middle part of the test piece.

TEST EXAMPLE 1

FIG. 3 illustrates the relation of the Mo content of Ni—Al—Mo alloys to the tensile strength at 1,000°C of the Ni—Al—Mo alloys which are within the basic composition range of the Si-containing Ni—Al—Mo alloy of this invention and in the vicinity thereof. The curves H, I and J shown in FIG. 3, respectively, correspond to lines *h*, *i* and *j* in the triangular coordinate diagram shown in FIG. 1. The curves H, I and J show the tensile strength at 1,000°C of the Ni—Al—Mo alloys having the composition represented by the straight lines *h*, *i* and *j* in FIG. 1, respectively. The compositions of Ni—Al—Mo alloys at given points on the curves H, I and J can be obtained from the corresponding straight lines *h*, *i* and *j* of FIG. 1, based on the Mo contents of said given points, respectively. The straight line *h* in FIG. 1 indicates compositions replacing the Al in $Ni_3Al$ with Mo and represents the line connecting $Ni_3Al$ to $Ni_3Mo$. The straight line *j* indicates compositions replacing Ni in $Ni_3Al$ with Mo. The straight line *i* is positioned between the two straight lines *h* and *j* and indicates compositions with Mo being added to $Ni_3Al$.

As known from FIG. 3, the tensile strength curves H, I and J show the maximum high temperature tensile strengths of about 56, 44 and 36 kg/mm$^2$, respectively, at the each Mo content of about 15%, and also they show great high temperature tensile strengths at the Mo content of from 10 to 20%. The Ni—Al—Mo alloys composed of the basic components, containing 10 to 20% of Mo, show high temperature tensile strength at least 1.5 times are great as the tensile strength 19 kg/mm$^2$ of the heat resisting alloy $Ni_3Al$ at 1,000°C. However, when Mo content exceeds 20%, the high temperature tensile strength sharply decreases. This decrease is believed to result from the fact that the $Ni_3Mo$ content in the alloy comes to surpass $Ni_3Al$ as the Mo content exceeds 20%. On the other hand, when Mo content is less than 10%, it is believed that the solid solution of $Ni_3Al$ is little reinforced by the Mo.

TEST EXAMPLE 2

Figure 4:
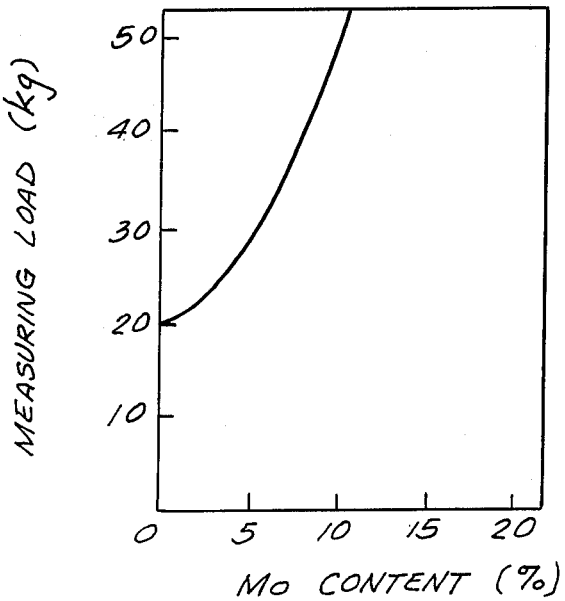
FIG. 4 is a graph showing the relation of the measuring loads which represents the toughness of the Ni—Al—Mo alloys at room temperature to the Mo content thereof.

FIG. 4 illustrates the relation between the toughness at room temperatures of ternary Ni—Al—Mo alloys including the range of the basic components of the basic constituent of the invented Si-containing Ni—Al—Mo alloy and the Mo content. The test samples were selected from the Ni—Al—Mo alloys having the compositions on the line *h* shown in FIG. 1. Based on the Mo content of each test sample, the Ni and Al contents of each of the test samples can be obtained from the corresponding points on the line *h* in FIG. 1, and also the toughness of each of the test samples can be obtained from FIG. 4.

As is apparent from the curve of FIG. 4, the toughness comes to exceed the upper value of the measuring load 50 kg at the Mo content of about 10% and the degree of toughness is too high to be measured by this measuring method. This indicates that the Ni—Al—Mo ternary alloys within the range of the basic components of the basic constituent of the Si-containing Ni—Al—Mo alloy of this invention with the Mo content exceeding 10% possess great toughness having values of more than 50 kg, which is more than 2.5 times as much as the toughness of 20 kg of the conventional $Ni_3Al$ alloy. Further in the invented alloy, insufficient toughness which often presents problems with the conventional heat resisting alloys is eliminated, and also it proved that the invented alloy has a good ductility.

TEST EXAMPLE 3

Figure 5:
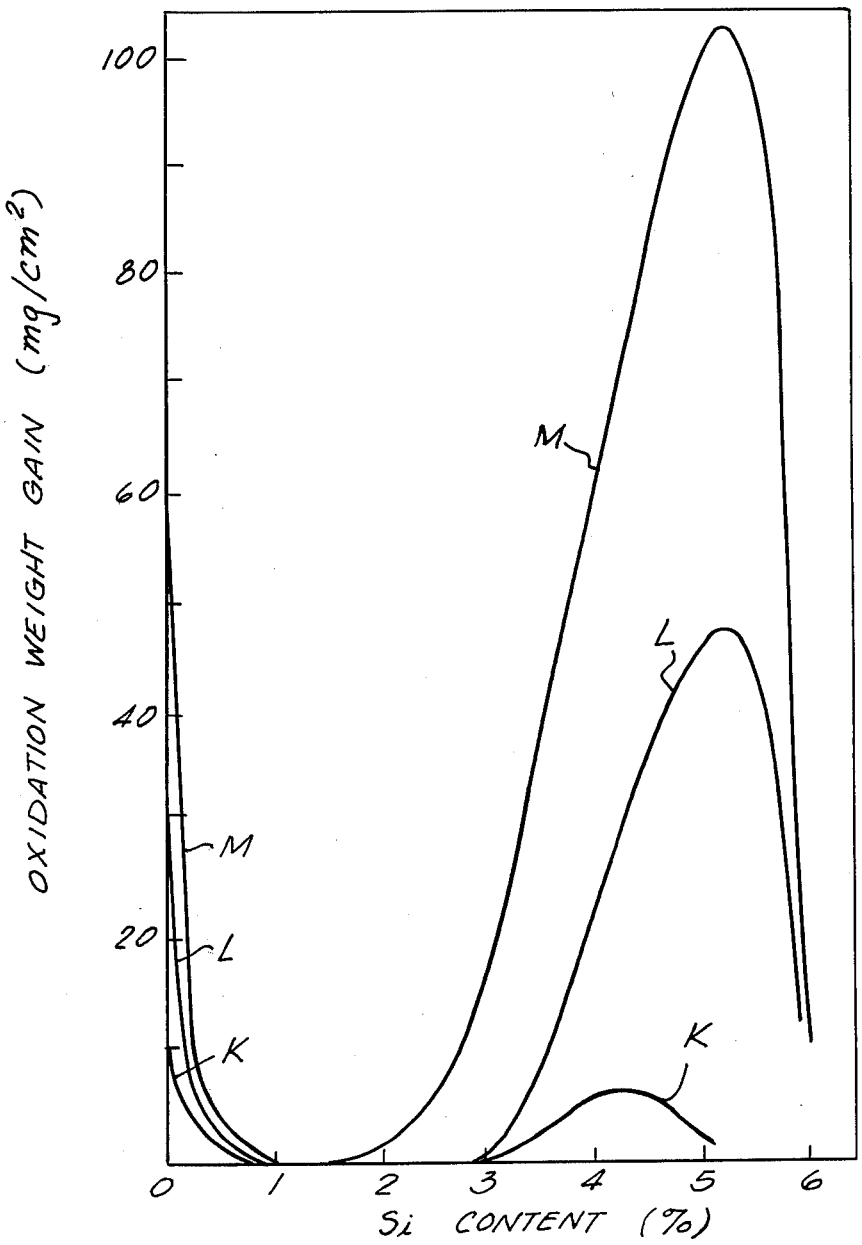
FIG. 5 is a graph showing the relation of the oxidation weight gain which represents the oxidation resisting property of the invented alloy prepared by adding Si to the basic components Ni, Al and Mo to the Si content thereof.

FIG. 5 illustrates the relation of the oxidation weight gain at 1,200°C to Si content of each of Si-containing Ni—Al—Mo alloys which were prepared by adding various quantities of Si to the Ni—Al—Mo alloy comprising 76.4% Ni, 7.0% Al and 16.6% Mo. Said Ni—Al—Mo alloy corresponds to the composition represented at the point E in FIG. 1 and is within the range of the basic components of the basic constituent of the invented Si-containing Ni—Al—Mo alloy. The oxidation weight gain per unit surface area is indicated on the ordinate in mg/cm$^2$, while the Si content in the Si-containing Ni—Al—Mo alloy is indicated on the abscissa. In FIG. 5, the curves K, L and M, respectively, represent the weight gains of the Si-containing Ni—Al—Mo alloys due to oxidation after heating said alloys at 1,200°C for 5, 21, and 69 hours, respectively. All of the three curves K, L and M indicate that the oxidation weight gain is greatly lowered by adding a small amount of Si such as 0.1%. However, the oxidation weight gain begins to increase as the Si content exceeds 3%. Thus, each of said alloys shows an excellent oxidation resisting property within the Si contents ranging from 0.1 to 3%. The more preferably range of Si content is from 0.25 to 2.5%. Within this range, the oxidation weight gain is less than 2.5 mg/cm$^2$ even after heating for 69 hours. The oxidation weight gains of the Ni—Al—Mo alloys containing Si of 0.25 to 2.5% are only one several tength of those of the Ni—Al—Mo alloys not containing Si. As already mentioned, the oxidation weight gain begins to increase as the Si content exceeds 3%, but the oxidation resisting property of the Ni—Al—Mo alloy containing 3.5% of Si becomes inferior compared with that of the Ni—Al—Mo alloy composed of only basic components. However, the oxidation resisting property again improves as the Si content exceeds 6%.

From the curves of the graph of FIG. 5, it is seen that while improved oxidation resistance occurs with even 0.1% Si present in the alloy, the oxidation weight gain decreases as the lower limit of the range 0.25–2.5% Si is increased. For example, an alloy with at least 0.5% Si has better oxidation resistance than an alloy containing 0.25% Si and an alloy with 1% Si has better oxidation resistance properties than the alloy with 0.5% Si. In a similar manner, when the upper limit of the range of 0.25–2.5% Si is lowered to approximately 2% Si, the oxidation weight gain for samples heated for 69 hours is reduced in comparison to the oxidation weight gain for the sample having 2.5% Si. Thus alloys of the present invention having silicon in the range of 0.5–2.5%, 1–2.5% and 1–2% will give improved oxidation resistance over the broader range of 0.1–3% Si.

The spalling weight which is measured concurrently with the oxidation weight gain shows a value about four times as much as the oxidation weight gain. The decrease of the spalling weight based on the Si content shows a similar tendency to that of the oxidation weight gain. This indicates that the oxidation resisting property of Ni—Al—Mo alloys proceeds with spalling. Next, test pieces, of a Ni—Al—Mo alloy containing no Si and of a Ni—Al—Mo alloy containing 1.5% of Si were heat treated for 69 hours, respectively, and then the surfaces and the exfoliated flakes thereof were subjected to X-ray diffraction test, respectively. In the test results described above, oxides, such as NiO, $NiAl_2O_4$, $NiMoO_4$ and $MoO_2$ were observed from the surface and the exfoliated flake of the former test piece, on the other hand NiO, $NiAl_2O$, $Ni_2SiO_4$ and a very small quantity of $NiMoO_4$ were observed from those of the later test piece. In view of the test results, it is believed that $NiMoO_4$ and $MoO_2$ which do not serve as a coating layer for preventing the alloy from oxidation are almost completely removed from the surface of the alloy and are replaced with $Ni_2SiO_4$ which effectively serves as a coating layer, by the addition of Si, so that the oxidation is restrained thereby from proceeding to the inner part of the alloy. Furthermore, according to the results of other tests, the addition of Si to Ni—Al alloys containing no Mo does not serve to improve their oxidation resisting property.

TEST EXAMPLE 4

The tensile strength at 1,100°C of the Ni—Al—Mo alloys containing Si which were prepared by adding various quantities of Si to a Ni—Al—Mo alloy (corresponding to point E in FIG. 1) comprising 76.4% Ni, 7.0% Al and 16.6% Mo in the range of the basic components or the basic constituent of the Si-containing Ni—Al—Mo alloy were examined. FIG. 6 illustrates the relation of the above stated tensile strength (kg/mm$^2$) to Si content (%) of each thereof. Tensile strength is represented on the ordinate and the Si content on the abscissa. The highest tensile strength which is about 41 kg/mm$^2$ was obtained from the Ni—Al—Mo alloy containing about 0.25% of Si. The tensile strength of each of the alloys then gradually decreased as the Si content of each of the alloys increases. The tensile strength of Ni—Al—Mo alloy containing about 0.5% of Si became about equal to that of the Ni—Al—Mo alloy containing no Si (at point E in FIG. 1). Then the tensile strength of a Ni—Al—Mo alloy containing 3% of Si became about 30 kg/mm$^2$. Although such decrease in tensile strength is not desirable, the fact that such a high tensile strength as 30 kg/mm$^2$ is retained at a temperature of 1,100°C indicates a sufficient heat resisting strength. This is apparent also from the comparison with the conventional $Ni_3Al$ alloy, of which the tensile strength shows only 19 kg/mm$^2$ at 1,000°C under a similar test shown in test example 1.

The above described Test Examples 1 through 4 explain the reasons why the basic components of the invented Si-containing Ni—Al—Mo alloy is set within the range enclosed by the points A, B, C and D shown in FIG. 1 and also explain why the Si content is within the range from 0.1 to 3%.

The following embodiments of the Si-containing Ni—Al—Mo alloy of this invention show the values of oxidation resisting property and tensile strength at high temperatures, etc. in comparison with the conventionally known excellent heat resisting alloy Inconel (Trade Mark) 713C (0.1% C, 12.5% Cr. 4.2% Mo, 2.0% Nb, 0.8% Ti, 6.1% Al, 0.012% B, 0.1% Zr and the rest Ni).

EMBODIMENT 1

A Si-containing Ni—Al—Mo alloy of this invention was obtained by melting 76.0% metallic Ni pieces, 6.9% high purity Al pieces, 16.54% metallic Mo pieces and 0.5% Si pieces under an argon atmosphere. The basic components or the basic constituents of this alloy corresponds to the compositions of the Ni, Al and Mo represented by the point E in FIG. 1.

Test pieces for high temperature tensile test were made from a rod obtained by uni-directionally solidifying this alloy. The test pieces were subjected to tensile tests at 1,000°C, 1,100°C, and 1,200°C, respectively, and also some of the test pieces were heated for 69 hours at 1,200°C under the air atmosphere. Table 1 shows the results of the above tests. Table 2 shows the mean coefficients of thermal expansion ($10^{-6}$/°C), from 20°C to each of the measuring temperatures 200°, 400°, 600° and 800°C. To measure the toughness of this alloy, Charpy impact test was also conducted using a test piece prepared by casting this alloy by an ordinaray casting process, a test piece prepared by uni-directionally solidifying this alloy and a test piece prepared by uni-directionally solidifying this alloy and then by heating it for 16 hours at 1,200°C. The results of the Charpy impact test on these test pieces are as shown in Table 3.

For reference sake, the measure values of the conventional heat resisting alloy Inconel 713C in tensile strength at 1,100°C, oxidation weight gain after heating it at 1,200°C for 69 hours and the mean coefficient of thermal expansion are indicated in Tables 1 and 2, respectively.

Table 1

| Alloys | Tensile Strength, kg/mm² 1000°C | 1100°C | 1200°C | Oxidation Weight Gain |
|---|---|---|---|---|
| Si-containing Ni-Al-Mo alloy of this Example: | 60.5 | 36.9 | 14.0 | 2.5 mg/cm² |
| Inconel 713C: | — | 14.0 | — | 7.5 mg/cm² |

Table 2

| Alloys | Mean Coefficient of Thermal Expansion From 20°C × $10^{-6}$/°C 200°C | 400°C | 600°C | 800°C |
|---|---|---|---|---|
| Si-containing Ni-Al-Mo alloy of this Example: | 10.8 | 11.5 | 11.7 | 12.5 |
| Inconel 713C: | 11.9 | 12.9 | 13.9 | 15.0 |

Table 3

| Charpy Impact Test Results of Si-Containing Ni-Al-Mo Alloy of this Example, kg-m/cm² | |
|---|---|
| Alloy prepared by ordinary casting process: | 3.0 |
| Alloy prepared by uni-directionally solidifying: | 4.5 |
| Alloy prepared by uni-directionally solidifying and then by heating at 1200°C for 16 hours: | 7.6 |

As clearly understood from Table 1, the Si-containing Ni—Al—Mo alloy has a high temperature tensile strength (at 1,100°C) of more than 2.5 times compared with that of the conventional heat resisting alloy Inconel 713C. It also possesses an excellent oxidation resisting property showing an oxidation weight gain which is only one third of the Inconel 713C. As to the mean coefficient of the thermal expansion from 20°C to each of the measuring temperatures 200°, 400°, 600° and 800°C, as shown in Table 2, the Si-containing Ni—Al—Mo alloy possesses advantageous properties as heat resisting material showing a lower value than Inconel 713C at every measuring temperature. In the Charpy impact test, the test results vary with the casting and heating conditions of the test pieces in the range from 3.0 to 7.6 kg-m/cm². However, the values within this range show a high toughness as heat resisting material.

EMBODIMENT 2

A Si-containing Ni—Al—Mo alloy of this invention was prepared in the same manner as Embodiment 1, which comprises 72.5% Ni, 10.5% Al, 16.5% Mo and 0.5% Si.

The tensile strength of this alloy was about 43 kg/mm² at 1,000°C and the oxidation weight gain thereof after heating at 1,200°C for 69 hours was 2.3 mg/cm².

EMBODIMENT 3

Another Si-containing Ni—Al—Mo alloy of this invention was prepared in the same manner as in Embodiment 1, which comprises 70.6% Ni, 12.4% Al, 16.5% Mo and 0.5% Si.

The tensile strength at 1,000°C of the alloy of this embodiment was about 35 kg/mm² while the weight gain due to oxidation thereof after heating at 1,200°C for 69 hours was 2.2 mg/cm².

Briefly stated, the heat resisting alloy of this invention comprises by weight of 0.1 to 3% of Si and the basic components of Ni, Al and Mo. The basic components have the compositions within the range enclosed by the points A, B, C and D shown in FIG. 1. A silicon-containing Ni—Al—Mo alloy according to the present invention excels not only in tensile strength and oxidation resisting property at high temperatures but also in toughness at room temperatures. This invention thus provides a heat resisting alloy that have a wide range of applications including steam turbines, gas turbines, apparatuses in the chemical industries, etc., as high temperature heat resisting materials.

The Si-containing Ni—Al—Mo alloy of this invention is not limited to a pure Ni—Al—Mo—Si alloy. The properties of the alloy will not be affected by small quantities of impurities such as iron (Fe), cobalt (Co), copper (Cu), etc., contained in the commercially available metallic Ni, metallic Al, metallic Mo, metallic Si. Alloys containing such impurities may be included in the scope of the invented Si containing Ni—Al—Mo alloy as long as they comprise Ni, Al and Mo as basic components within the composition range enclosed by the points A, B, C and D shown in FIG. 1 and as long as they contain by weight of 0.1 to 3% of Si.

We claim:

1. A heat resisting alloy consisting essentially of a basic constituent; and an additive of silicon in the range of 0.5–2.5% by weight of the total alloy; said basic constituent comprising nickel, aluminum and molybdenum in the following percentage by weight of the basic constituent: nickel 65–85%, aluminum 5–15% and molybdenum 10–20%.

2. A heat resisting alloy according to claim 1, wherein said additive of silicon is no less than 1% by weight of the total alloy.

3. A heat resisting alloy according to claim 1, wherein said additive of silicon is in a range of 1–2% by weight of the total alloy.

4. A heat resisting alloy according to claim 1, wherein the molybdenum is present in the basic constituent in a range of 13–17% by weight of the basic constituent.

5. A heat resisting alloy accordinng to claim 1, wherein the percentage of molybdenum in the basic constituent is 15%.

6. A heat resisting alloy according to claim 1, wherein the percentage by weight of the nickel, aluminum and molybdenum of the basic constituent is in the range of 75–80% nickel, 6–8% aluminum and 15–18% molybdenum.

7. A heat resisting alloy according to claim 1, wherein the percentage by weight of the nickel, aluminum and molybdenum of the basic constituent is nickel 76.4%, aluminum 7% and molybdenum 16.6%.

8. A heat resisting alloy according to claim 7, wherein the additive of silicon is in the range of 1–2% by weight of the total alloy.

9. A heat resisting alloy according to claim 1, wherein the percentage by weight of the basic constituent is nickel 76%, aluminum 6.9%, molybdenum 16.54% and having an additive of silicon of 0.5% by weight of the total alloy.

10. A heat resisting alloy according to claim 1, wherein the percentage by weight of the basic constituent is nickel 72.5%, aluminum 10.5%, molybdenum 16.5% and having an additive of silicon of 0.5% by weight of the total alloy.

11. A heat resisting alloy according to claim 1, wherein the percentage by weight of the basic constituent is nickel 70.6%, aluminum 12.4%, molybdenum 16.5% and having a additive of silicon of 0.5% by weight of the total alloy.

* * * * *